US008529291B2

(12) United States Patent
Kuhlmann

(10) Patent No.: US 8,529,291 B2
(45) Date of Patent: Sep. 10, 2013

(54) WALL BUSHING PLUG CONNECTOR AND FASTENING ELEMENT FOR IT

(75) Inventor: Friedhelm Kuhlmann, Lage (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 13/231,117

(22) Filed: Sep. 13, 2011

(65) Prior Publication Data

US 2012/0071023 A1 Mar. 22, 2012

(30) Foreign Application Priority Data

Sep. 21, 2010 (DE) ..... 10 2010 045 913

(51) Int. Cl.
*H01R 13/60* (2006.01)

(52) U.S. Cl.
USPC ..... 439/549; 439/557; 439/565

(58) Field of Classification Search
USPC ..... 439/544, 549, 557, 567, 575, 565, 439/562
See application file for complete search history.

(56) References Cited

U.S. PATENT DOCUMENTS

| | | | | |
|---|---|---|---|---|
| 4,560,227 | A * | 12/1985 | Bukala | 439/557 |
| 5,238,427 | A | 8/1993 | Fry et al. | |
| 5,535,074 | A | 7/1996 | Leung | |

FOREIGN PATENT DOCUMENTS

| | | | |
|---|---|---|---|
| DE | 1 098 565 | | 2/1961 |
| DE | 103 29 894 | B3 | 5/2005 |
| DE | 103 15 661 | B4 | 11/2005 |
| DE | 10 2005 062 059 | | 7/2007 |
| DE | 102 16 574 | B4 | 1/2010 |
| EP | 1 655 813 | A1 | 5/2006 |

* cited by examiner

*Primary Examiner* — Felix O Figueroa
(74) *Attorney, Agent, or Firm* — Renner, Otto, Boisselle & Sklar, LLP

(57) ABSTRACT

A wall bushing plug connector which is to be led through and latched in a wall cutout in a housing wall, having an insulating material housing and having two sprung fastening latching arms which are arranged so as to spring outward on mutually opposite sides of the insulting material housing in opposite directions and have at least one latching edge for latching to the housing wall, and the wall bushing plug connector also having mutually opposite clamping contact sections. The sprung fastening latching arms are integrally formed on a support section opposite their free end so as to leave a clearance, with the clearance being intended to accommodate a retaining section of a mating plug connection which can be plugged onto the plug connector for connection to connection contacts.

9 Claims, 4 Drawing Sheets

WALL BUSHING PLUG CONNECTOR AND FASTENING ELEMENT FOR IT

Figure 1:
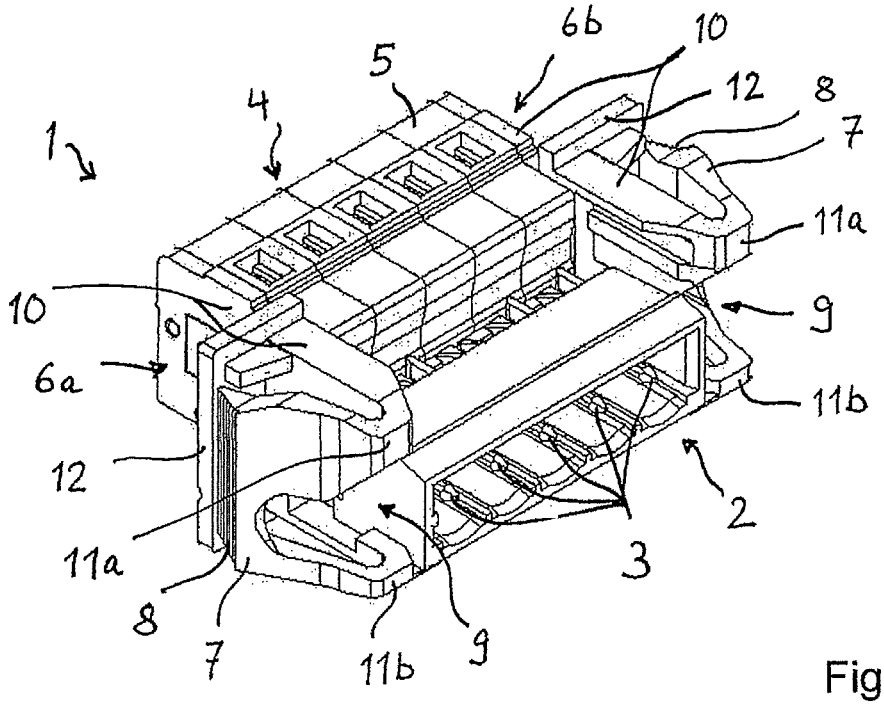

The invention relates to a wall bushing plug connector which is to be led through and latched in a wall cutout in a housing wall, having a (possibly multipartite) insulating material housing and having two sprung fastening latching arms which are arranged so as to spring outward on mutually opposite sides of the insulating material housing in opposite directions and have at least one latching edge for latching to the housing wall of a wall cutout, and also having mutually opposite clamping contact sections.

The invention also relates to a fastening element for fastening a wall bushing plug connector in a wall cutout.

Electrical and electronic devices often have plug connectors which lead out of a housing wall, said plug connectors making it easier to connect electrical lines to the device. These plug connectors are inserted into wall cutouts and are fastened to the housing wall, for example by screwing, in that position.

DE 10 2005 062 059 B4 describes an electrical connection terminal having a fastening device for leading a line through a housing wall. A fastening insert is accommodated in an accommodation space in a terminal housing. Fastening screws are screwed into the fastening insert, said fastening screws pressing latching apparatuses of the terminal housing against the housing wall.

EP 1 655 813 A1 discloses an electrical connection terminal having a fastening element which has a U-shaped base body and a latching tongue which runs parallel to the base body. Fixing elements of the U-shaped base body can be pressed against a corresponding inner edge of the wall opening by an operating wedge which is arranged on the free end of the U-limb in a pivotable manner. In addition, the latching tongue is also deflected out to such an extent that it is pressed firmly against the respective inner edge of the wall openings and the electrical connection terminal is securely fixed in the wall opening in the housing wall when the electrical connection terminal is in the installed state.

DE 103 15 661 B4 describes a similar locking element for a wall bushing plug connector. A pivotable operating wedge is integrally connected to a locking element and can be pivoted-in between two limbs of the locking element for the purpose of locking the locking element.

U.S. Pat. No. 6,709,286 B1 describes an electrical plug connector having insertion openings at the lateral edge regions. The plug connector is secured to the housing wall with the aid of separate fastening elements. The fastening elements are pushed into associated insertion openings and engage over the housing wall on that side of the housing which is opposite the rest of the plug connector.

Furthermore, DE 102 16 574 B4 discloses a wall installation housing for electrical components having sprung fastening latching means. The fastening latching means become wedged laterally against the side edges of a housing wall cutout.

Proceeding from this prior art, the object of the present invention is to provide an improved wall bushing plug connector and a fastening element for fastening a wall bushing plug connector.

The object is achieved with the wall bushing plug connector of the type mentioned in the introductory part in that the sprung fastening latching arms are integrally formed on a support section opposite their free end so as to leave a clearance, with the clearance being intended to accommodate a fastening section of a mating plug connector which can be plugged onto the plug connector for connection to connection contacts.

The clearance creates an insertion opening for a fastening section of a mating plug connector, said fastening section being positioned between the support section and the fastening latching arm. In this way, the mating plug connector can be fixed to the wall bushing plug connector with the aid of the fastening section in the clearance in order to prevent the mating plug connector from being withdrawn from the wall bushing plug connector under tensile loading. It is also feasible for the fastening latching arms which are latched to the wall bushing to be held in a securely latched manner by the fastening section, which enters the clearance, of a mating plug connector when the mating plug connector is plugged onto the wall bushing plug connector.

It is particularly advantageous when the fastening elements are provided as separate parts independently of the insulating material housing of the plug connector. In this case, the fastening elements each have a support section and a fastening latching arm which is integrally formed on said support section. In this case, the fastening elements and the insulating material housing have plug sections which are matched to one another so as to interengage in order to in each case plug-connect a fastening element to an associated side wall of the insulating material housing. Therefore, plug connectors can optionally be converted into a wall bushing plug connector without a great deal of expenditure.

A fastening element according to the invention of this kind therefore has a support section with an abutment face with plug sections for butting against a side wall of an insulating material housing of the wall bushing plug connector and for engaging in associated plug sections of the insulating material housing, and also a sprung fastening latching arm. The fastening latching arm has a free end which has at least one latching edge for butting against the housing wall or optionally for latching (possibly depending on the thickness of the housing wall) on a side inner edge of a wall cutout, and is integrally formed on the support section opposite this free end.

A largely universal fastening part is created with the aid of a separate fastening element of this kind, it being possible to use said fastening part for a large number of different plug connectors. In this way, clamping elements which can be lined up with one another can, for example, be joined to form a plug connector with a selectable width and can be formed as wall bushing plug connectors with the aid of the fastening elements on the two outer side walls.

It is also advantageous here when the sprung fastening latching arm is integrally formed on a support section so as to leave a clearance. The clearance then in turn serves to accommodate a fastening section of a mating plug connector which can be plugged onto the plug connector for connection to connection contacts. In this case, the fastening section can serve to secure the mating plug connector to the plug connector and/or to secure the latching means of the associated fastening latching arm in the latching position.

The plug sections can have, for example, latching holes and/or projecting latching pins. Therefore, it is feasible for latching pins to project from the abutment face of the support section which is intended to butt against the side wall of an insulating material housing of a plug connector, said latching pins entering latching openings on the side wall of the insulating material housing and fixing the fastening element in a defined position on the plug connector. In a corresponding manner, latching openings can also be present in the abutment face of the support section, it being possible for latching pins which project from a side wall of the insulating material housing to enter said latching openings. The separate fastening elements can therefore be easily plugged, and preferably also latched, onto associated side walls of the plug connector in a defined position.

It is also advantageous when a resting means for resting on a wall region of the housing wall which adjoins the wall cutout extends away from the support section so as to adjoin the free end of a fastening latching arm. The plug connector therefore rests against one side of the housing wall by way of the rest. The fastening latching arm then engages against the inner edge of the housing wall from the opposite side or is situated on the housing wall, so that the wall bushing plug connector is fixed in the wall cutout on both sides.

Figure 2:
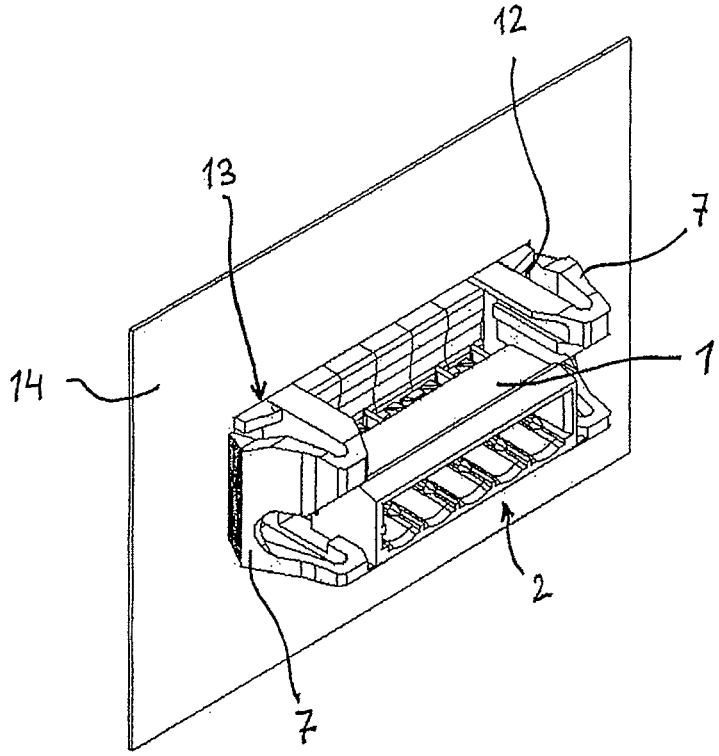
Figure 3:
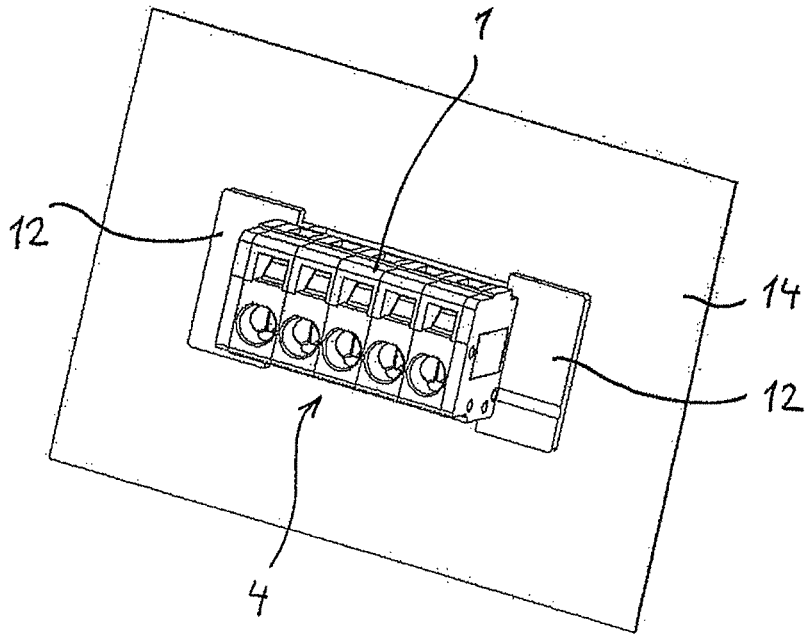
Figure 4:
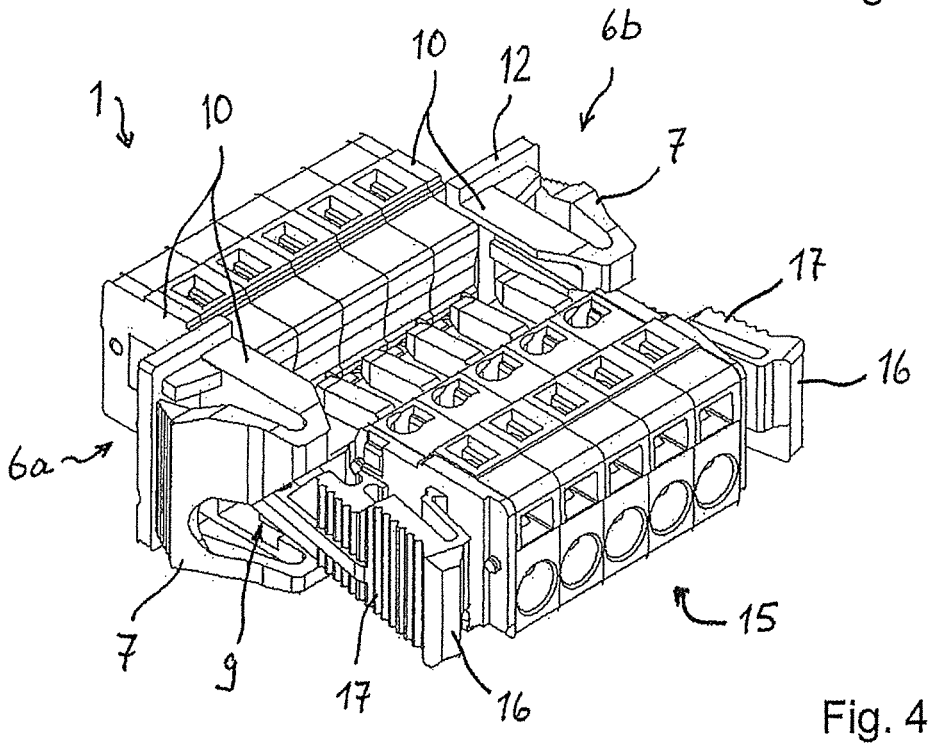
Figure 5:
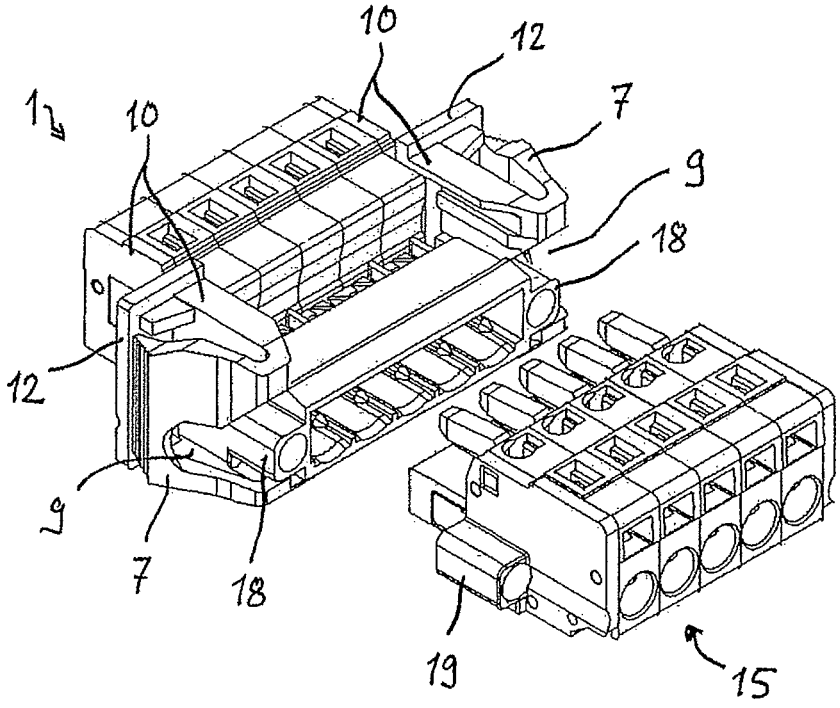
Figure 6:
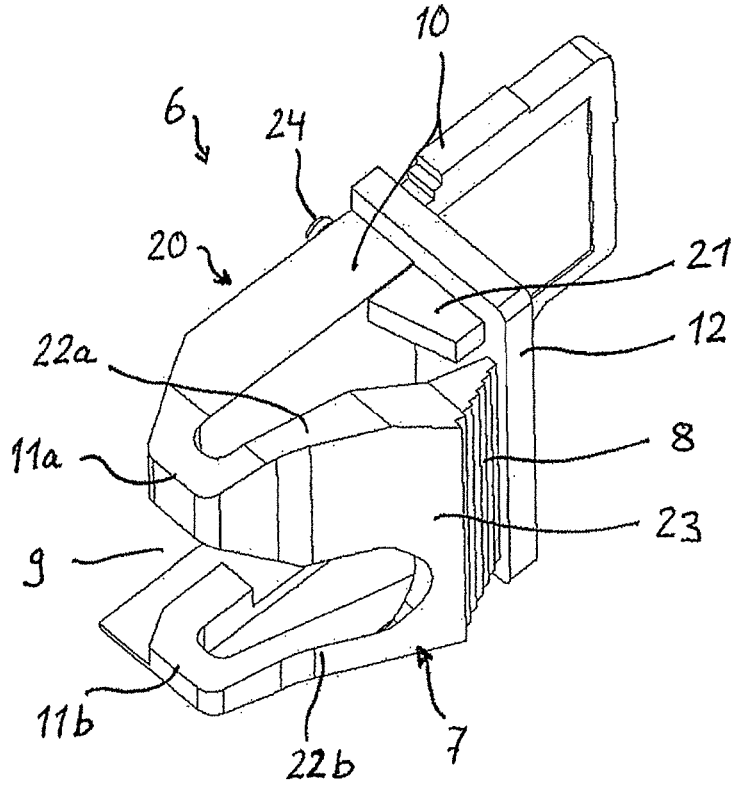
Figure 7:
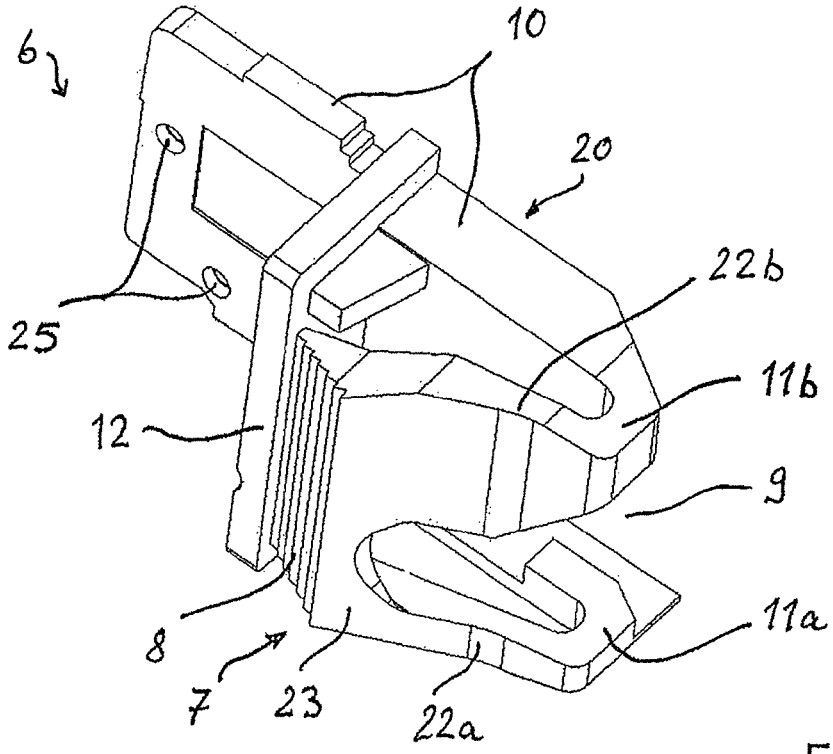

The invention will be explained in greater detail below with reference to exemplary embodiments together with the appended drawings, in which:

FIG. 1—shows a perspective view of a wall bushing plug connector;

FIG. 2—shows a perspective front view of the wall bushing plug connector from FIG. 1 which is inserted into a wall cutout;

FIG. 3—shows a perspective rear view of the wall bushing plug connector from FIG. 1 which is inserted into a wall cutout;

FIG. 4—shows a perspective view of the wall bushing plug connector from FIG. 1 with a first embodiment of a mating plug connector;

FIG. 5—shows a perspective view of a wall bushing plug connector with another mating plug connector;

FIG. 6—shows a perspective view of a fastening element which can be plug-connected to a wall bushing plug connector and has latching pins; and FIG. 7—shows a perspective view of a fastening element which can be plug-connected to a wall bushing plug connector and has latching holes.

FIG. 1 shows a perspective front view of a wall bushing plug connector 1 having a front clamping contact section 2 in which contact pins 3 are arranged. The front clamping contact section 2 serves to accommodate a corresponding clamping contact section of a mating plug connector in order to electrically conductively connect clamping contact connections of a mating plug connector to the contact pins 3. A clamping contact section 4 is likewise provided on the rear face in order to electrically conductively connect electrical lines to associated contact pins 3 directly or by means of a further plug connector.

The wall bushing plug connector 1 is formed from a, possibly multipartite, insulating material housing 5, fastening elements 6*a*, 6*b* being plug-connected to the side walls of said insulating material housing. The fastening elements 6*a*, 6*b* each have fastening latching arms 7 which spring outward away from the insulating material housing 5. In the illustrated exemplary embodiment, the free ends of the fastening latching arms 7 are slightly concavely curved and equipped with latching edges 8 in this curved portion. These latching edges 8 serve to latch the wall bushing plug connector to an adjoining inner edge of a wall cutout into which the wall bushing plug connector 1 is inserted.

Opposite the free end of the fastening latching arms 7, said fastening latching arms are integrally formed on a support section 10 so as to leave at least one clearance 9. The support section 10 extends along the adjacent side wall of the insulating material housing 5 of the wall bushing plug connector. In this case, the fastening latching arms 7 are integrally formed on the associated support section 10 such that they extend from the front clamping contact section 2 in the direction of the rear clamping contact section 4 by way of their free end. The clearance 9 is created by the fastening latching arms 7 being integrally formed on the support section 10 at the opposite outer edge regions opposite the free end by way of two spring bows 11*a*, 11*b* which are spaced apart from one another.

A rest 12 which extends transversely away from the respective support section 10 and is integrally formed with the support section 10 is located adjacent to the free ends of the fastening latching arms 7 so as to leave an intermediate space. The rests 12 serve to rest on wall regions which adjoin the wall cutout 13 and to completely close the wall cutout 13.

FIG. 2 shows the wall bushing plug connector 1 from FIG. 1 in the state in which it is inserted in a wall cutout 13 in a housing wall 14. It is clear that the rests 12 close the wall cutouts 13. Said figure also shows that the fastening latching arms 7 automatically spring out behind the wall cutout 13 and rest on the housing wall 14 after the wall bushing plug connector 1 is inserted into the wall cutout 13 in the insertion direction and after passing through the wall cutout 13. This prevents the wall bushing plug connector 1 from being pulled out. The wall bushing plug connector 1 is therefore firmly clamped into the housing wall 14 between the rests 12 and the fastening latching arms 7.

FIG. 3 shows a perspective rear view of the wall bushing plug connector 1 which is inserted into a housing wall 14. It is clear that the rests 12 rest on the housing wall 14 and further insertion of the wall bushing plug connector 1 through the wall cutout is prevented.

Said figure also shows that a clamping contact section 4 with a plurality of clamping connections are provided on the rear face, it being possible for electrical conductors to be electrically conductively connected to the wall bushing plug connector 1 directly or by means of plug connectors at said clamping connections.

FIG. 4 shows the perspective view of the wall bushing plug connector 1 from FIGS. 1 to 3 with a mating plug connector 15. The mating plug connector 15 is plugged onto the front clamping contact section 2 of the wall bushing plug connector 1. Latching elements 16 with latching arms 17 are provided on the outer faces of the narrow edges of the mating plug connector 15, said latching arms entering the clearances between the support section 10 and the fastening latching arms 7 of the fastening elements 6*a*, 6*b*. In this way, it is possible to secure the mating plug connector 15 with the latching arms 17 in the clearance to the plug connector 1 and, at the same time, to prevent the fastening latching arms 7 pivoting back in the direction of the support section 10. The wall bushing plug connector 10 is securely clamped in the wall cutout in this way.

The fastening latching arms 7 can likewise be separate auxiliary elements which can be plugged onto the mating plug connector 15 from the side. However, it is also feasible for the fastening latching arms 7 to be integrally formed with the mating plug connector 15 on the insulating material housing.

FIG. 5 shows a slightly modified embodiment of the wall bushing plug connector 1, in which fastening sleeves 18 of the plug connector 1 enter the clearances in each case. The fastening sleeves 18 each have fastening holes for accommodating a fastening screw with which the mating plug connector 15 can be screwed to the plug connector 1. Corresponding fastening sleeves 19 are present on the side wall of the mating plug connector 15, it being possible for a fastening screw to be routed through fastening sleeves in each case.

FIG. 6 shows an embodiment of a fastening element 6 which is formed separately from the wall bushing plug connector from a plastic material. Said fastening element comprises the support section 10 which has an abutment face 20 for butting against a side wall of an insulating material housing of the wall bushing plug connector. The rest 12 in the form of a rectangular plate starts transversely from the support section 10 in the opposite direction to the abutment face 20. The rest 12 is supported by supporting webs 21 which start from the support section 10. These supporting webs 21 are additionally provided at an abutment edge against an inner edge of a wall cutout.

The fastening latching arms 7 are formed in a U shape and have two limbs 22*a*, 22*b* which adjoin the spring bows 11*a*, 11*b* and merge with the free end of the fastening latching arms 7 by way of a crossmember 23.

In the embodiment which is illustrated in FIG. 6, plug sections in the form of latching pins 24 are provided on the abutment face 20, said latching pins projecting from the abutment face 20 in the opposite direction to the spring direction of the fastening latching arm 7 and to the direction of extent of the rest 12 from the support section 10. The latching pins can be inserted into corresponding latching openings in the side wall of the insulating material housing of the wall bushing plug connector.

The fastening element 6 therefore forms a separate part with which a plug connector 1 can be converted into a wall bushing plug connector. The wall bushing plug connector 1 can, as shown in FIGS. 2 and 3, be clamped into a housing wall with the aid of these separate fastening elements which can be plug-connected to two opposite side walls of the insulating material housing of the wall bushing plug connector 1.

FIG. 7 shows another embodiment of the fastening element from FIG. 6. In said figure, the plug sections on the abutment face 20 are not realized by means of latching pins but rather by latching holes 25. In this embodiment, corresponding latching pins which can enter the latching holes 25 are provided on the side walls of the wall bushing plug connectors in this case.

The invention claimed is:

1. A wall bushing plug connector which is to be led through and latched in a wall cutout in a housing wall comprising:

an insulating material housing;

two sprung fastening latching arms which are arranged so as to spring outward on mutually opposite sides of the insulating material housing in opposite directions, and have at least one latching edge for latching to the housing wall; and mutually opposite clamping contact sections, wherein the two sprung fastening latching arms are integrally formed on a support section opposite a free end of each of the two sprung fastening latching arms, the two sprung fastening latching aims each having:

two spring bows spaced apart from each other so as to leave a clearance; and two limbs each adjoining one of the two spring bows, and the two limbs merging with the free end of at least one of the two sprung fastening latching arms by way of a crossmember, wherein the clearance accommodates a retaining section of a mating plug connector configured to be plugged onto the wall bushing plug connector for connection to connection contacts.

2. The wall bushing plug connector as claimed in claim 1 further comprising:

fastening elements provided separately from the insulating material housing, said fastening elements each having a support section, and a fastening latching arm which is integrally formed on said support section, wherein the fastening elements and the insulating material housing having plug sections which are matched to one another so as to interengage in order to plug-connect a one of the fastening elements to an associated side wall of the insulating material housing.

3. The wall bushing plug connector as claimed in claim 2, wherein the plug sections have latching holes and/or projecting latching pins.

4. The wall bushing plug connector as claimed in claim 1 further comprising:

a rest for resting on a wall region which adjoins the wall cutout and extends away from the support section adjacent to the free end of one of the two sprung fastening latching arms.

5. The wall bushing plug connector as claimed in claim 1, wherein the clearance is formed such that a fastening section which is accommodated in the clearance and holds one of the two sprung fastening latching arms in a latching position.

6. A fastening element for fastening a wall bushing plug connector in a wall cutout in a housing wall comprising:

a support section with an abutment surface with plug sections for butting against a side wall of an insulating material housing of the wall bushing plug connector and for engaging in the plug sections of the insulating material housing, and a sprung fastening latching arm having a free end which has at least one latching edge for latching to the housing wall and is integrally formed on the support section opposite the free end, wherein the sprung fastening latching arm is formed by a pair of spring bows distant from each other and integrally formed on the support section, and wherein the clearance is provided between said pair of spring bows, wherein the sprung fastening latching arm has a pair of limbs each adjoining one of said pair of spring bows, and the pair of limbs merging with the free end of the sprung fastening latching arm by way of a crossmember.

7. The fastening element as claimed in claim 6, wherein the clearance is intended to accommodate a fastening section of a mating plug connection configured to be plugged onto the plug connector for connection to connection contacts, said fastening section holding the fastening latching arm in a latching position.

8. The fastening element as claimed in claim 6, wherein the plug sections have latching holes and/or projecting latching pins.

9. The fastening element as claimed in claim 6 further comprising:

a rest for resting on a wall region which adjoins the wall cutout and extends away from the support section so as to adjoin the free end of the sprung fastening latching arm.

* * * * *